United States Patent [19]

Scheurecker

[11] 4,223,717

[45] Sep. 23, 1980

[54] METHOD OF REPAIRING A PLATE MOULD TO BE USED FOR CONTINUOUS CASTING OF STEEL

[75] Inventor: Werner Scheurecker, Linz, Austria

[73] Assignee: Voest-Alpine Aktiengesellschaft, Linz, Austria

[21] Appl. No.: 52,346

[22] Filed: Jun. 27, 1979

[30] Foreign Application Priority Data

Jul. 5, 1978 [AT] Austria ..... 4858/78

[51] Int. Cl.[3] ..... B22D 11/00

[52] U.S. Cl. ..... 164/76; 29/402.06; 164/82

[58] Field of Search ..... 164/1, 6, 82, 137, 418, 164/443, 76; 29/402.06

[56] References Cited

U.S. PATENT DOCUMENTS 2,340,450 2/1944 Bouschor ..... 29/402.06

FOREIGN PATENT DOCUMENTS 238390 2/1962 Austria .
250598 11/1966 Austria .
1125594 3/1962 Fed. Rep. of Germany .
1200558 7/1970 United Kingdom ..... 164/443

*Primary Examiner*—Robert D. Baldwin
*Attorney, Agent, or Firm*—Brumbaugh, Graves, Donohue & Raymond

[57] ABSTRACT

A method of repairing a plate mould including a supporting frame, narrow-side walls and broad-side walls forming a rectangular mould cavity and supported against the supporting frame, the narrow-side walls being inserted between the broad-side walls formed of a supporting plate and a cooled inner-wall plate and the inner wall being designed in three parts, the partition joints extending in the longitudinal direction of the mould, in which method, in order to keep material losses as low as possible, each of the three parts is worked off to become plane and complemented by a respective equally thick part to form a new inner-wall plate.

2 Claims, 2 Drawing Figures

METHOD OF REPAIRING A PLATE MOULD TO BE USED FOR CONTINUOUS CASTING OF STEEL

BACKGROUND OF THE INVENTION

The invention relates to a method of repairing a plate mould for casting steel strands, in particular steel slabs, which plate mould comprises a supporting frame against which the walls defining a rectangular mould cavity are supported, wherein the narrow-side walls are inserted in between broad-side walls assembled of a supporting plate and a cooled inner-wall plate, and wherein the inner-wall plate of each broad-side wall is designed in three parts, the partition joints extending approximately in the longitudinal direction of the mould.

It has been observed with plate moulds, that the copper mould side walls are subjected to a greater wear by material abrasion in the regions of the corners of the mould cavity than in the regions between the corners. When reconditioning the mould, it is necessary for the re-creation of even side wall faces of the mould side walls to refinish the copper plates of the side walls over their total extension, according to the greatest wear. In particular with plate moulds for continuous casting plants for slabs, this refinishing is especially costly, since the broad-side walls, in the region between the narrow-side walls bordering at them, also have to be refinished to the extent to which the abrasion at the broad- side walls in the regions of the narrow-side walls, i.e. in the corner regions, has proceeded. This results in a great loss of material of wall parts that have been subjected to a slight wear only.

From German Pat. No. 1,125,594 it is known to form the broad-side walls of a continuous casting mould having a rectangular cross section, of several wall parts, the partition joints between these wall parts extending approximately in the longitudinal direction of the mould. The individual wall parts of each broad-side wall are centered to each other by groove and tongue, so that, also with this mould, each broad-side wall always has to be worked off in accordance with the maximally occurring wear, if a completely plane broad-side wall is to be produced a new.

SUMMARY OF THE INVENTION

The invention aims at avoiding these disadvantages and difficulties and has as its object to provide a method of repairing a plate mould with which the material layer to be worked off during refinishing is justified by the extent of the abrasion, great losses of material at wall parts that have been subjected to a slight wear only being prevented.

This object is achieved according to the invention in that, after a wear has occurred at the inner-wall plates, each part of their respective three parts will be worked off by the greatest extent of wear appearing on the respective part, so as to become plane, and in that these parts are complemented with equally thick parts for the formation of a new inner-wall plate.

BRIEF DESCRIPTION OF THE DRAWINGS

The invention will now be described in more detail by way of one embodiment and with reference to the accompanying drawing, wherein.

DESCRIPTION OF THE ILLUSTRATED EMBODIMENTS

Figure 1:
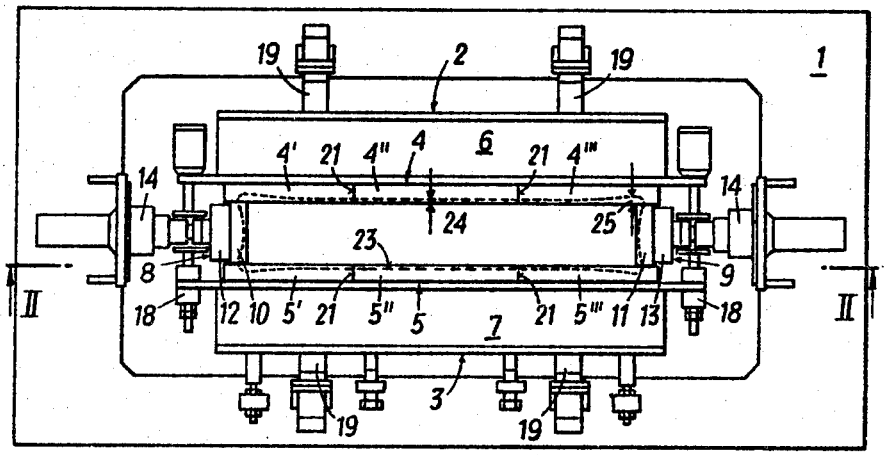
FIG. 1 is a top view onto a slab mould.

In FIG. 1, the supporting frame of a mould, designed as a water box, is denoted by 1, into which the broad-side walls 2, 3 of the mould are inserted and against which these walls are supported. Each of these two broad- side walls 2, 3 is provided, at the inner side, with inner- wall plates designed as cooled copper plates 4, 5, which are fastened to supporting plates 6, 7 of these walls 2, 3. The narrow-side walls 8, 9 also comprise copper plates 10, 11 mounted on supporting plates 12, 13. The narrow-side walls 8, 9 each can be parallelly displaced by means of a drive 14 via threaded spindles 15 for adjustment to different slab formats, and their inclinations can be changed. The greatest slab width to be adjusted is denoted by 16, and the smallest one is denoted by 17. Clamping means 18 at the end sides of the broad- side walls serve for clamping the narrow-side walls 8, 9 between the broad-side walls. The water supply of the cooled copper plates 4, 5, 10 and 11 of the broad-side walls 2, 3 and of the narrow-side walls 8, 9, respectively, is effected via connection pieces 19, 20, the connection pieces 20 for the narrow-side walls 8, 9 being telescopically extractable and retractable, according to the respective position of these walls. The position of the broad-side walls 2, 3 depends on the dimensions of the narrow-side walls 8, 9 clamped between them.

The copper plates 4, 5 of the broad-side walls 2, 3 are assembled of three wall parts 4', 4'', 4''', and 5', 5'', 5''', respectively, the partition joints 21 between these wall parts extending in the direction of the mould axis 22. The partition joints 21 might also be inclined according to the inclination resulting from the shrinkage of the strand slab, of the narrow-side walls 8, 9. The individual wall parts 4', 4'', 4''', and 5', 5'', 5''', respectively, of the copper plates 4, 5 are separately exchangeable.

The wear of the copper plates is schematically illustrated in FIG. 1 by the broken line 23. According to this wear, during reconditioning of the mould, the central wall or innermost part 4'', 5'' of the copper plates 4, 5 must be worked off only extremely slightly by the measure 24, whereas the two outermost side-wall parts 4', 4''', 5', 5''' that are arranged in the region of the narrow-side walls 8, 9 must be worked off by the measure 25. According to the invention, these outermost side-wall parts 4', 4''', 5', 5''' are exchanged for replacement outermost side- wall parts that have a thickness corresponding to the thickness of the central wall parts 4'', 5'' after they have been worked off. The side-wall parts 4', 4''', 5', 5''' worked off by the measure 25, are then used again, when the central wall parts 4'', 5'' of the copper plates 4, 5 have been worked off by this measure 25, due to further abrasion.

Up to now, the inner-wall plate allocated to the broad-side wall has always been worked off according to the maximal wear occurring. According to the invention, it suffices to work off each one of the central wall parts 4'', 5'' only by the greatest extent of wear 24 actually occurring at those parts. This gives rise to an optimal utilization of the materials of the central wall parts and to repeated possibilities for use of the central wall parts of the broad-side walls 2, 3 which always are subjected (as can be seen from FIG. 1) to a considerably slighter wear than the parts of the broad-side walls that are arranged at the corners of the mould.

Figure 2:
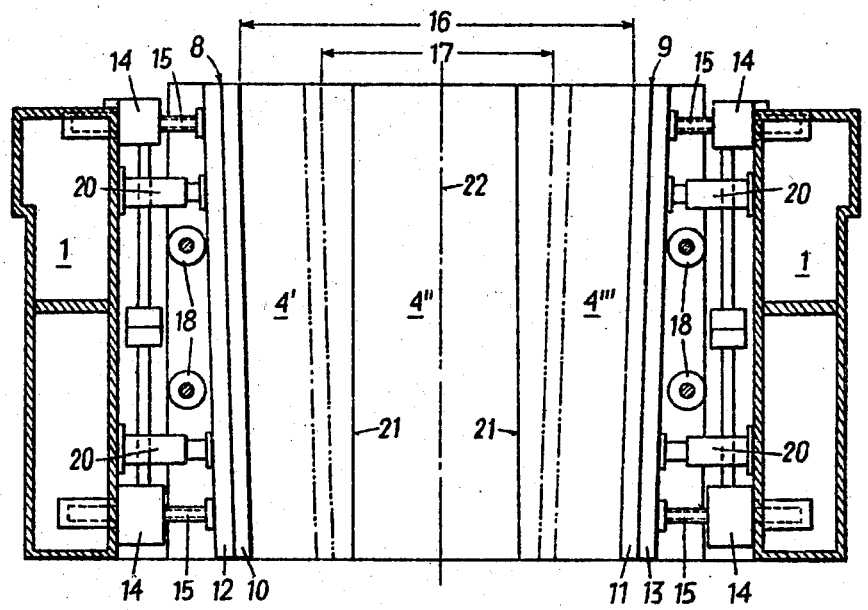
FIG. 2 illustrates a vertical section through the longitudinal axis according to the section line II—II of FIG. 1.

As can be seen from FIG. 2, the partition joints 21 are arranged within the minimum width 17 of the mould cavity to be adjusted, whereby the extremely intensive wear at the corners of the mould at the central parts 4'', 5'' of the copper walls 4, 5 cannot occur.

What I claim is:

1. In a method of repairing a plate mould to be used for continuous casting of steel, in particular steel slabs, of the type including a supporting frame, mould walls defining a rectangular mould cavity and supportd against said supporting frame, said mould walls including narrow- side walls and broad-side walls, each one of said broad-side walls being assembled of a supporting plate and a cooled inner-wall plate, and said narrow-side walls being inserted between said broad-side walls, said inner- wall plate being designed in three parts so as to form partition joints between said three parts extending approximately in the longitudinal direction of said plate mould, the improvement which is characterized in that, after occurrence of wear at said inner-wall plates, each one of said three parts thereof is worked off by a measure corresponding to the greatest extent of wear having occurred on the respective part, so as to become plane, and the innermost part thereof is complemented by equally thick outermost replacement parts so as to form a new inner-wall plate.

2. The method of claim 1 further characterized in that after subsequent occurrence of wear at said new inner-wall plate, the innermost part thereof is worked off by a measure corresponding to said greatest extent of wear that occurred on the original outermost parts, and said innermost part is then complemented by the equally thick original outermost parts so as to form a second new inner-wall plate.

* * * * *